US007634895B2

(12) United States Patent
Chan

(10) Patent No.: US 7,634,895 B2
(45) Date of Patent: Dec. 22, 2009

(54) GIFT DISPLAY BOX

(76) Inventor: Michael L. F. Chan, 1407 Arch St., Berkeley, CA (US) 94708

( * ) Notice: Subject to any disclaimer, the term of this patent is extended or adjusted under 35 U.S.C. 154(b) by 237 days.

(21) Appl. No.: 11/460,886

(22) Filed: Jul. 28, 2006

(65) Prior Publication Data

US 2006/0272962 A1 Dec. 7, 2006

Related U.S. Application Data

(62) Division of application No. 10/608,054, filed on Jun. 27, 2003.

(51) Int. Cl.
*B65B 11/58* (2006.01)

(52) U.S. Cl. ..... 53/449

(58) Field of Classification Search ..... 53/449, 53/133.3, 135.2, 136.1, 136.3, 136.4, 136.5; 206/736, 772, 774, 775, 776, 232, 457
See application file for complete search history.

(56) References Cited

U.S. PATENT DOCUMENTS

| | | | | | |
|---|---|---|---|---|---|
| 610,337 | A | | 9/1898 | Ames | |
| 1,650,039 | A | | 11/1927 | Price | |
| 1,682,449 | A | | 8/1928 | Vest | |
| 1,860,586 | A | | 5/1932 | McIlhenney | |
| 2,019,250 | A | * | 10/1935 | Collins | 206/777 |
| 2,636,597 | A | | 4/1953 | Hinz | |
| 2,655,260 | A | | 10/1953 | Clerc | |
| 3,286,905 | A | | 11/1966 | Farukhi | |
| 3,415,407 | A | | 12/1968 | Alden et al. | |
| 3,568,827 | A | | 3/1971 | Haring | |
| 3,684,084 | A | * | 8/1972 | Kanzelberger | 206/773 |
| 4,154,338 | A | | 5/1979 | Adler | |
| 4,160,503 | A | | 7/1979 | Ohlbach | |
| 4,330,060 | A | | 5/1982 | Thornton | |
| 4,506,823 | A | | 3/1985 | Biichler | |
| 4,549,656 | A | | 10/1985 | Barnes et al. | |
| 4,739,353 | A | | 4/1988 | Hener et al. | |
| 4,763,789 | A | | 8/1988 | Quested et al. | |
| 4,867,372 | A | | 9/1989 | Patterson | |
| 5,038,930 | A | | 8/1991 | Holtkamp, Jr. | |
| 5,232,087 | A | | 8/1993 | Schluger | |
| 5,277,307 | A | | 1/1994 | Kelly | |
| 5,353,931 | A | | 10/1994 | Antik | |
| 5,409,105 | A | | 4/1995 | Apelbaum et al. | |
| 5,526,597 | A | | 6/1996 | Plotkin et al. | |
| D383,064 | S | * | 9/1997 | Tsukikawa | D9/432 |
| 5,673,796 | A | * | 10/1997 | Tulloch | 206/769 |
| 5,775,494 | A | | 7/1998 | Taplin | |
| 5,860,589 | A | | 1/1999 | Hsu | |
| 6,010,000 | A | * | 1/2000 | Tran | 206/424 |
| 6,030,274 | A | | 2/2000 | Kaplan | |
| 6,398,026 | B1 | | 6/2002 | Parsons | |
| 6,409,568 | B1 | | 6/2002 | Sogaard et al. | |
| 6,749,064 | B1 | * | 6/2004 | Alrey | 206/457 |
| 6,761,269 | B2 | * | 7/2004 | Hamming | 206/777 |
| 2002/0162757 | A1 | | 11/2002 | Parsons | |

* cited by examiner

*Primary Examiner*—Hemant M Desai
(74) *Attorney, Agent, or Firm*—Schneck & Schneck; Thomas Schneck

(57) ABSTRACT

A device for display and mailing of a gift. The device includes an inner gift holding box having a transparent top surface through which a display item could be viewed. This inner gift box is inserted into an outer mailing box. When the gift holding box is nested into the outer mailing box, the gift may still be viewed through a cutout on the top of outer mailing box. An opaque panel is inserted inside the outer mailing box over the transparent top surface of inner gift holding box. This panel allows the mailing box to be shipped without showing the contents of the box.

3 Claims, 3 Drawing Sheets

GIFT DISPLAY BOX

CROSS-REFERENCE TO RELATED APPLICATION

This is a divisional application of pending U.S. patent application Ser. No. 10/608,054 filed Jun. 27, 2003.

TECHNICAL FIELD

The present invention relates to gift boxes.

BACKGROUND OF THE INVENTION

In selling gifts, merchants want to present a gift in an attractive display, and add value to the gift by providing customer needs at airport and gift shops visited by travelers. When traveling, people often desire to buy gifts for friends and relatives back home. However, given airport baggage restrictions, it is cumbersome to transport numerous gifts. Furthermore, if the gift includes metallic elements, a wrapped gift may have to be opened and inspected, causing travel delays. A merchant could add value to the gift by presenting the gift in an attractive package that could subsequently be mailed to a recipient. This package could allow display of the gift item, would provide a wrapping for the gift, and could be mailed to the recipient. Such a prepackaged item ideally would be ready to immediately be mailed to a recipient.

SUMMARY OF THE INVENTION

The present invention is a gift box that includes an inner box for holding a gift. The inner box includes a top transparent surface through which a display item may be seen. This inner box may be entirely transparent, such as vinyl box. This inner box may include a metallic display item and/or a card.

The inner box is nested to fit into an outer box. The outer box is a mailing box into which the inner gift holding box is inserted. This mailing box includes a cutout positioned such that when said gift holding box is inserted into the mailing box, a viewer may look through the cutout, through the transparent top surface of the gift holding box and view an item contained within the gift box. Fitting under the cutout is a removable opaque panel which may be inserted inside the mailing box over the top transparent surface of the gift holding box between the gift holding box and the mailing box. This removable opaque panel may include printing, such as a "to" and "from" section with lines allowing a sender to address the box for mailing. Alternatively, mailing information may be printed on the mailing box.

DETAILED DESCRIPTION OF THE INVENTION

Figure 1:
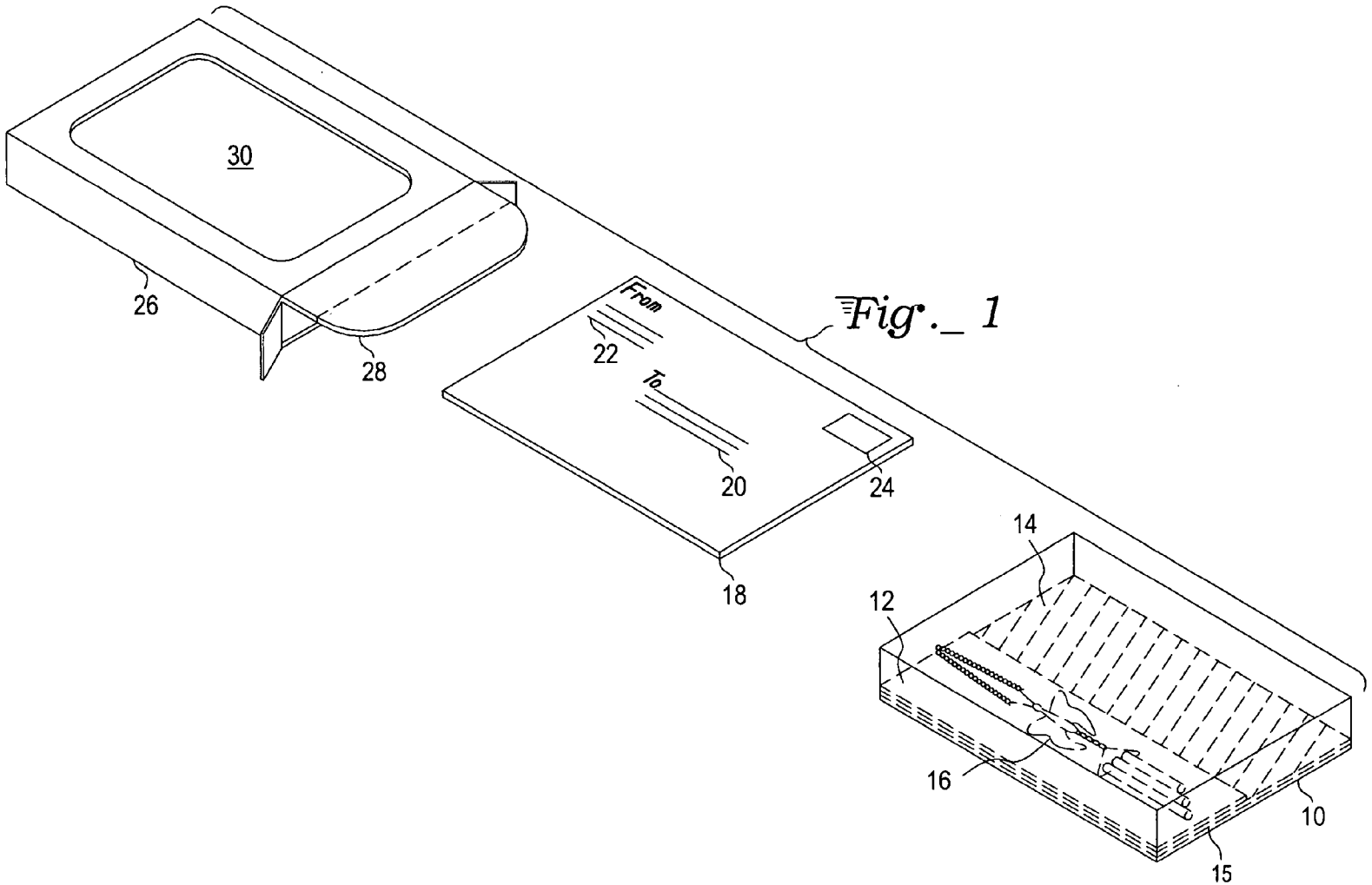
FIG. 1 is a perspective view of the display box, outer mailing box and removable opaque panel of the present invention.

The present invention includes three components. With reference to FIG. 1, a gift display box 10 includes a transparent top surface through which a display item 16 and/or card 12 and envelope 14 are visible. This gift display box may be a vinyl box that is transparent on all sides. This gift display box may be six-sided and may be rectangular. This box may include a top section and a bottom section, which are separated to open the box. The box may be closed with tape or other means. A sender could inscribe the gift card and include it in the gift box with the gift. The gift display box may include a display card 12 on which a small metal sculpture display item 16 or other small item is mounted.

Gift display box 10 is nested into outer mailing box 26, into which gift display box 10 snugly fits. Flap 28 may then be closed, securing display box 10 in mailing box 26. A cutout 30 on the outer mailing box 26 allows display box 10 to be viewed through mailing box 26. A merchant would have the option of displaying the display items 16 either alone on a display card 12, in display box 10 or in mailing box 26. It could be possible to sell the mailing box separately. It could also be possible to print onto mailing box 26 graphic decoration. The graphic decoration could allow this item to be used as a promotional item packing, a fund raising product, a corporate gift, or an advertising item. A printed advertisement or corporate logo could be printed on the package exterior. Decorating the outer box would make wrapping the box unnecessary. In another embodiment, the cutout 30 in the outer box could be blocked by changing the orientation of the inner box 10 wherein the transparent top faces away from the opening in the outer box.

Removable opaque panel 18 fits within outer mailing box 26 over the transparent top surface 15 of display box 10. Panel 18 could also include printing, such as a sender identification lines 22, a recipient identification lines 20 and a graphic indication 24 of where to affix the stamp. The box may be sold with postage stamp or a metering stamp already on the card. This allows a purchaser to simply address the box and send the box. This allows mailing without waiting, adding convenience for the customer. This stamp area may be preprinted with the bulk rate and postal mailing permit number to simplify the mailing procedure. This would reduce the postage rate and could save the need to weigh and sort each box. Panel 18 may be removed for the display of the gift box, and subsequently inserted to allow mailing of the gift box.

Figure 2:
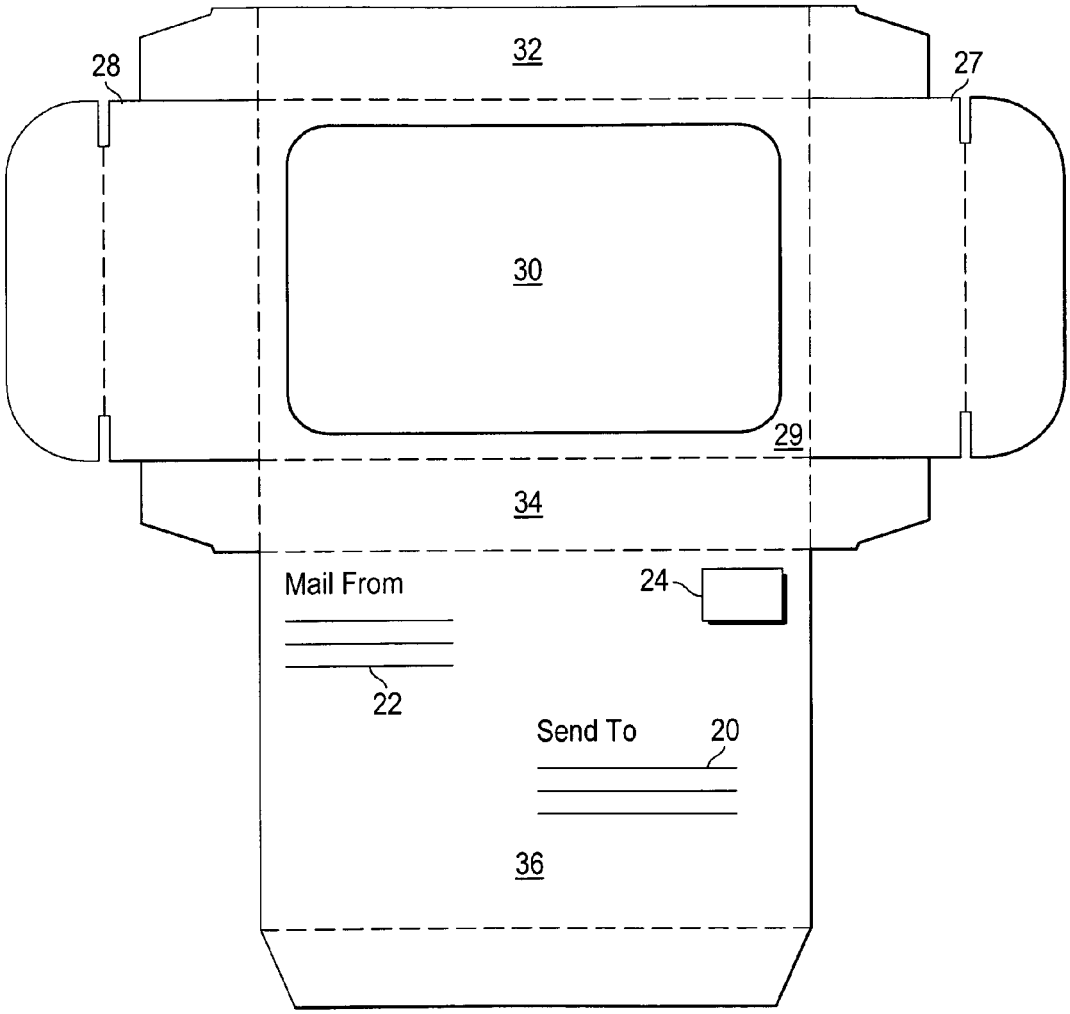
FIG. 2 is a printing layout of the outer mailing box of the present invention.
Figure 3:
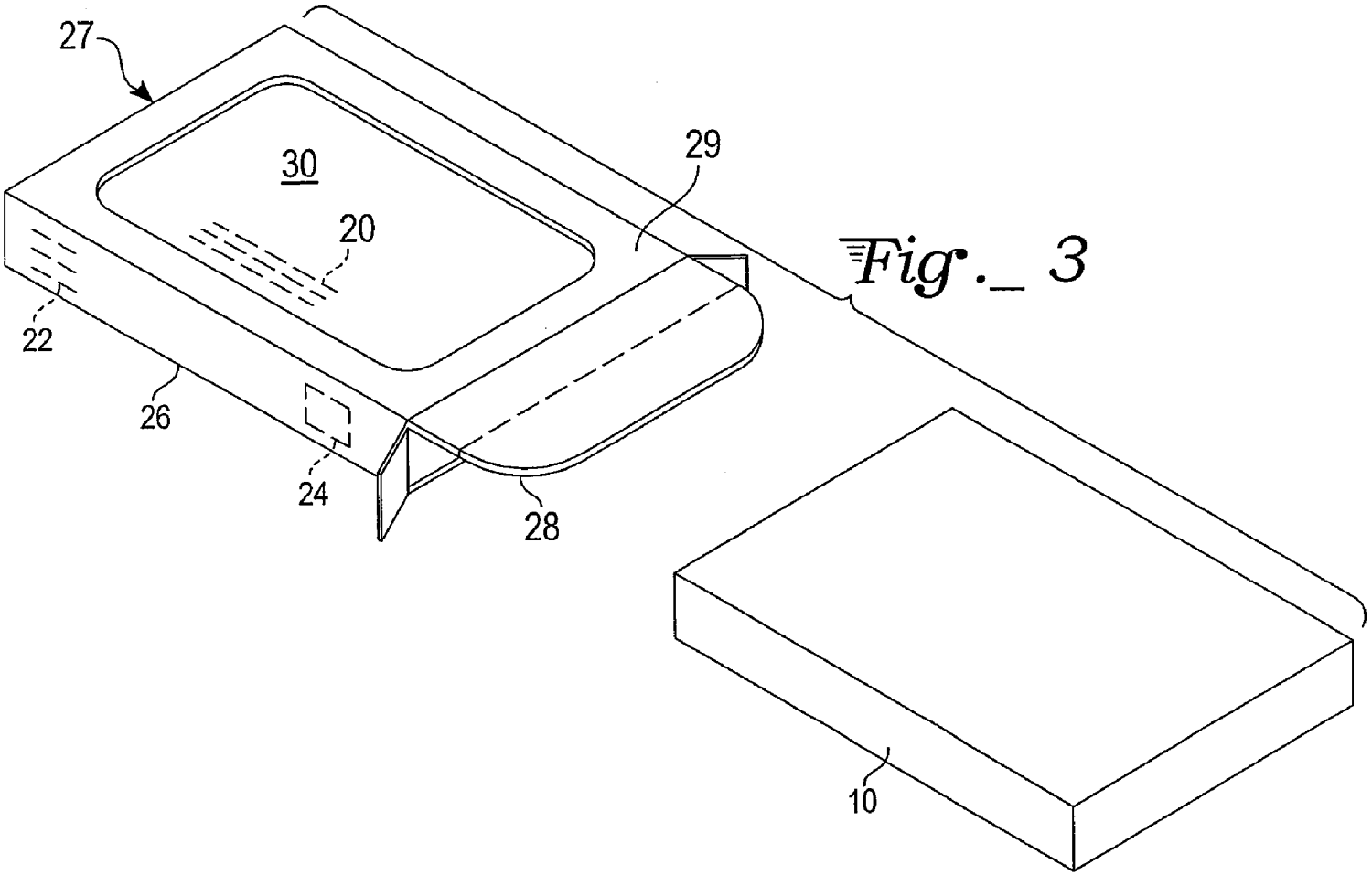
FIG. 3 is a perspective view of the display box and outer mailing box for the embodiment of FIG. 2.

FIGS. 2 and 3 show the assembly of the outer mailing box. An outer box top 29 has a cutout 30 to allow viewing through cutout 30. The sides of the box 32, 34 are folded down along the dashed lines. Back 36 of the box has an end flap which may be positioned by folding and glued to side 32. The end flaps 27, 28 are then folded to enclose the box. In this embodiment, the sender identification lines 22, recipient identification lines 20 and a graphic indication 24 of where to affix the stamp are on the back 36 of the outer box 26 as shown in FIGS. 2 and 3.

The invention claimed is:

1. A method for displaying and mailing a gift article comprising the following steps:

packaging a gift article in a closed inner box of rectangular cross section in top view having a bottom wall, opposing end walls, and a transparent top wall exposing the gift article to viewing from outside the inner box;

folding a single sheet of box material to form a six-sided outer box having foldable end flaps, a back side and a front side, wherein sender and recipient identifications are on the back side and a cutout region is on the front side, displaying the gift article by inserting the inner box in the outer box with said transparent top wall of the inner box facing towards the cutout in the outer box such that the gift article of the inner package is visible through the cutout and the transparent top wall of the inner box;

then packaging the inner box snugly within the outer box by changing the orientation of the inner box such that said transparent top wall of the inner box faces away from the cutout in the outer box, thus blocking the visibility of the gift article of the inner box through the cutout in the outer box at the time of mailing, closing the end flaps further blocking visibility of the end walls of the inner box; and mailing the outer box.

2. The method of claim 1 wherein the gift article is a mounted on a card arranged to be visible in the inner box through said transparent top wall therein.

3. The method of claim 2 further comprising displaying the gift article mounted on a card in the closed inner box before blocking the visibility of the inner box.

* * * * *